US011453030B2

(12) United States Patent
Kojima et al.

(10) Patent No.: US 11,453,030 B2
(45) Date of Patent: Sep. 27, 2022

(54) ULTRASONIC SENSOR AND ULTRASONIC APPARATUS

(71) Applicant: SEIKO EPSON CORPORATION, Tokyo (JP)

(72) Inventors: Chikara Kojima, Matsumoto (JP); Koji Ohashi, Matsumoto (JP); Hironori Suzuki, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 450 days.

(21) Appl. No.: 16/690,595

(22) Filed: Nov. 21, 2019

(65) Prior Publication Data

US 2020/0164407 A1 May 28, 2020

(30) Foreign Application Priority Data

Nov. 22, 2018 (JP) ..... JP2018-219027

(51) Int. Cl.
*B06B 1/06* (2006.01)
*B06B 1/02* (2006.01)

(52) U.S. Cl.
CPC ..... *B06B 1/0666* (2013.01); *B06B 1/0215* (2013.01)

(58) Field of Classification Search
CPC ..... A61B 8/00; A61B 8/4281; A61B 8/4427; A61B 8/4483; A61B 8/4494; B06B 1/0215; B06B 1/0622; B06B 1/0655; B06B 1/0666; G01N 29/34; G01S 7/521; G01S 15/08; H01L 41/047; H01L 41/0471; H01L 41/083; H01L 41/1132
USPC ..... 310/334
See application file for complete search history.

(56) References Cited

U.S. PATENT DOCUMENTS

2008/0259133 A1* 10/2008 Hara ..... B41J 2/14233 347/70
2015/0187347 A1* 7/2015 Kojima ..... H01L 41/0973 310/322
2017/0179365 A1 6/2017 Yonemura et al.
2018/0059067 A1* 3/2018 Miyazawa ..... A61B 8/4483
2018/0182949 A1 6/2018 Kojima et al.

FOREIGN PATENT DOCUMENTS

JP 2017-112282 A 6/2017
JP 2018-107571 A 7/2018

* cited by examiner

*Primary Examiner* — Stephen R Burgdorf
(74) *Attorney, Agent, or Firm* — Oliff PLC

(57) ABSTRACT

An ultrasonic sensor includes an opening portion, vibrating plate covering the opening portion, piezoelectric element overlapping with the opening portion, and a coupling electrode coupled to the piezoelectric element, extended from a position overlapping the opening portion to a position not overlapping the opening portion, and having a line width smaller than a width of the piezoelectric element. The piezoelectric has a first and second line portion, and a corner portion coupling the first and second line portions, when an intersection point connects a center of gravity of the piezoelectric and the corner portion with a virtual circle inscribed in the outline of the piezoelectric is a first intersection point of a tangent line. The first intersection point with the first and second line portions are a second and third intersection points, the coupling electrode coupled to a corner portion from the second intersection point to the third intersection point.

6 Claims, 12 Drawing Sheets

ULTRASONIC SENSOR AND ULTRASONIC APPARATUS

The present application is based on, and claims priority from JP Application Serial Number 2018-219027, filed Nov. 22, 2018, the disclosure of which is hereby incorporated by reference herein in its entirety.

BACKGROUND

1. Technical Field

The present disclosure relates to an ultrasonic sensor and ultrasonic apparatus.

2. Related Art

In related art, ultrasonic sensors having piezoelectric elements placed on thin-film vibrating plates are known (for example, see JP-A-2017-112282).

An ultrasonic sensor disclosed in JP-A-2017-112282 includes a substrate having a rectangular opening portion, a vibrating plate closing the opening portion, and a piezoelectric element provided on the vibrating plate. The piezoelectric element has a rectangular shape in a plan view as seen from a stacking direction of the substrate, the vibrating plate, and the piezoelectric element. Further, a wiring electrode is coupled to the piezoelectric element and signals can be input to and output from the piezoelectric element.

In the piezoelectric sensor, the vibrating plate may be vibrated to output ultrasonic wave by input of a signal to the piezoelectric element. When ultrasonic wave is received by the vibrating plate, reception of the ultrasonic wave may be detected by conversion of vibration of the vibrating plate into an electrical signal using the piezoelectric element.

Further, in the piezoelectric sensor, the vibrating plate is vibrated, and thus, when the line width of the wiring electrode coupled to the piezoelectric element is larger, the vibration of the vibrating plate is hindered and vibration characteristics of the vibrating plate are affected. On the other hand, in JP-A-2017-112282, the line width of the wiring electrode coupled to the piezoelectric element is smaller than the width of the piezoelectric element, and the electrode is coupled to a center part of a side of the rectangular piezoelectric element. Thereby, vibration hinderance of the vibrating plate may be suppressed.

However, when ultrasonic wave is output from the ultrasonic sensor as disclosed in JP-A-2017-112282, stress that vibrates the vibrating plate is applied to a position overlapping with the rectangular piezoelectric element of the vibrating plate. In this case, the amount of deformation at the center point of the piezoelectric element is the maximum and the amount of deformation is smaller with distance from the center point. Accordingly, with a focus on the edge of the rectangular piezoelectric element, in the center part of the side of the rectangular shape, the amount of deformation is larger than that in a corner part. Therefore, as disclosed in JP-A-2017-112282, if the line width of the wiring electrode is made smaller than the width of the piezoelectric element and the wiring electrode is coupled to the center part of the side of the rectangular piezoelectric element, the wiring electrode may be disconnected.

SUMMARY

An ultrasonic sensor according to a first application example includes a substrate having a first surface and a second surface in a front-back relationship with the first surface and having an opening portion penetrating from the first surface to the second surface, a vibrating plate provided on the first surface of the substrate and covering the opening portion, a piezoelectric element provided in a position overlapping with the opening portion in a plan view as seen from a direction from the first surface to the second surface in the vibrating plate, and a coupling electrode coupled to the piezoelectric element, extended from a position overlapping with the opening portion to a position not overlapping with the opening portion in the plan view, and having a line width smaller than a width of the piezoelectric element, wherein the piezoelectric element has an outline including a first line portion, a second line portion, and a corner portion coupling the first line portion and the second line portion in the plan view, when an intersection point of a first virtual line connecting a point of a center of gravity of the piezoelectric element and the corner portion with a virtual circle inscribed in the outline of the piezoelectric element is a first intersection point, an intersection point of a tangent line of the virtual circle at the first intersection point with the first line portion is a second intersection point, and an intersection point of the tangent line of the virtual circle at the first intersection point with the second line portion is a third intersection point, the coupling electrode is coupled to a corner portion neighborhood range from the second intersection point through the corner portion to the third intersection point in the outline of the piezoelectric element.

The ultrasonic sensor of the application example may include a first electrode provided on the vibrating plate, a piezoelectric material provided on the first electrode at an opposite side to the vibrating plate and covering the first electrode, and a second electrode provided on the piezoelectric material at an opposite side to the first electrode, wherein the first electrode may be provided inside of an outer peripheral edge of the second electrode in the plan view, the piezoelectric element may be formed by a part in which the first electrode, the piezoelectric material, and the second electrode overlap in the plan view, and the coupling electrode may be an electrode coupled to the first electrode.

The ultrasonic sensor of the application example may include a first electrode provided on the vibrating plate, a piezoelectric material provided on the first electrode at an opposite side to the vibrating plate, and a second electrode provided on the piezoelectric material at an opposite side to the first electrode, wherein the second electrode may be provided inside of an outer peripheral edge of the first electrode in the plan view, the piezoelectric element may be formed by apart in which the first electrode, the piezoelectric material, and the second electrode overlap in the plan view, and the coupling electrode may be an electrode coupled to the second electrode.

The ultrasonic sensor of the application example may include a first electrode provided on the vibrating plate, a piezoelectric material provided on the first electrode at an opposite side to the vibrating plate, and a second electrode provided on the piezoelectric material at an opposite side to the first electrode, wherein the second electrode may have the same shape as the first electrode and overlap with the first electrode in the plan view, the piezoelectric element may be formed by apart in which the first electrode, the piezoelectric material, and the second electrode overlap in the plan view, and the coupling electrode may include a first coupling electrode coupled to the first electrode and a second coupling electrode coupled to the second electrode.

The ultrasonic sensor of the application example may further include a terminal portion coupled to a circuit board, and a bypass electrode coupling the terminal portion and the coupling electrode, wherein the line width of the coupling electrode and a line width of the bypass electrode may be the same width.

An ultrasonic apparatus of a second application example includes the above described ultrasonic sensor of the first application example, and a control unit that controls the ultrasonic sensor.

DESCRIPTION OF EXEMPLARY EMBODIMENTS

First Embodiment

As below, the first embodiment will be explained.

Figure 1:
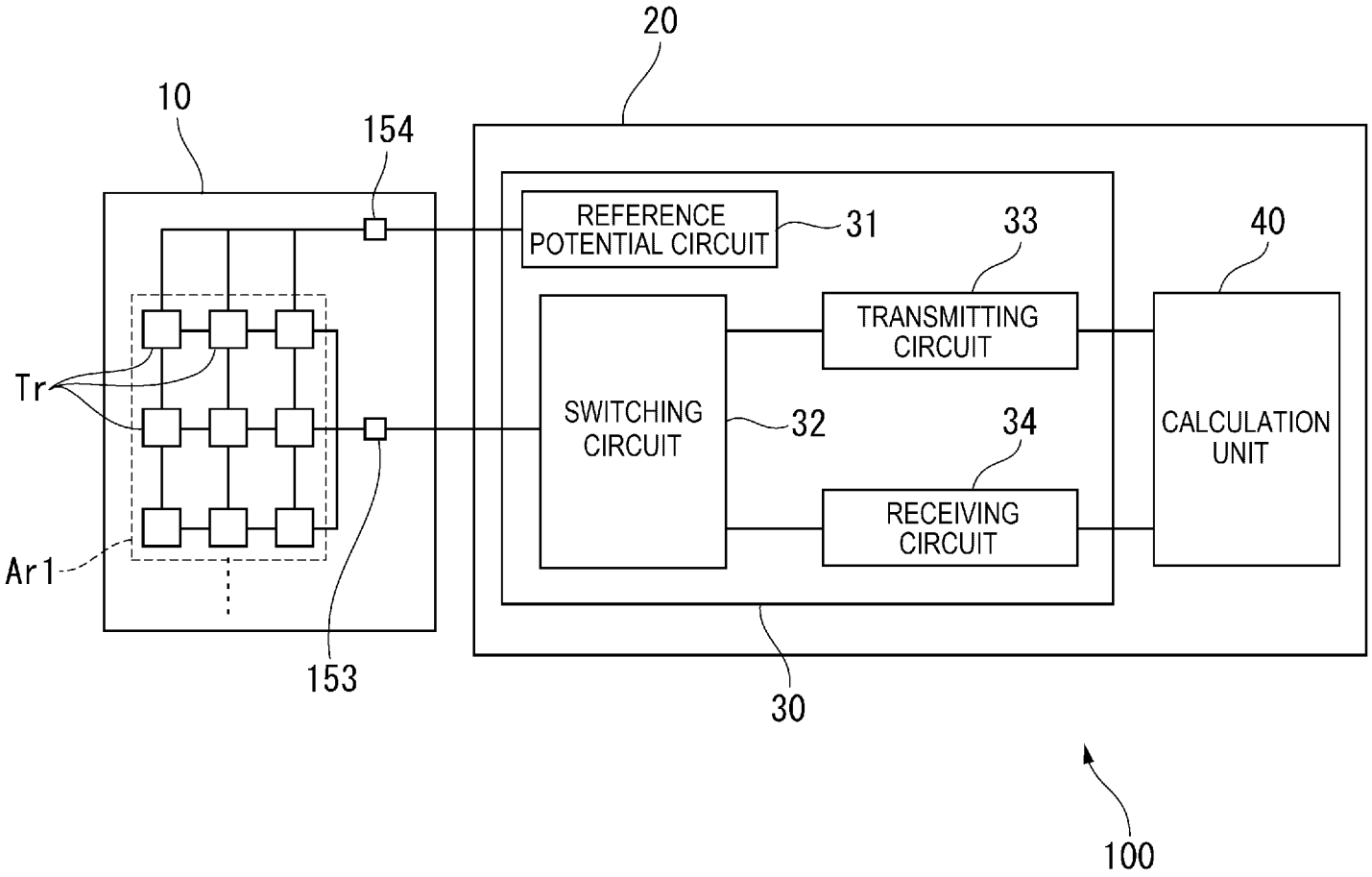
FIG. 1 is a block diagram showing a schematic configuration of a distance measuring apparatus as an example of an ultrasonic apparatus of a first embodiment.

FIG. 1 is the block diagram showing the schematic configuration of a distance measuring apparatus 100 as the example of the ultrasonic apparatus of the first embodiment.

As shown in FIG. 1, the distance measuring apparatus 100 of the embodiment includes an ultrasonic sensor 10 and a control unit 20 that controls the ultrasonic sensor 10. In the distance measuring apparatus 100, the control unit 20 controls the ultrasonic sensor 10 via a drive circuit 30 and transmits ultrasonic wave from the ultrasonic sensor 10. Further, when the ultrasonic wave is reflected by an object and reflected wave is received by the ultrasonic sensor 10, the control unit 20 calculates a distance from the ultrasonic sensor 10 to the object based on a time from the transmission time of the ultrasonic wave to the reception time of the ultrasonic wave.

As below, a configuration of the distance measuring apparatus 100 will be specifically explained.

Configuration of Ultrasonic Sensor 10

Figure 2:
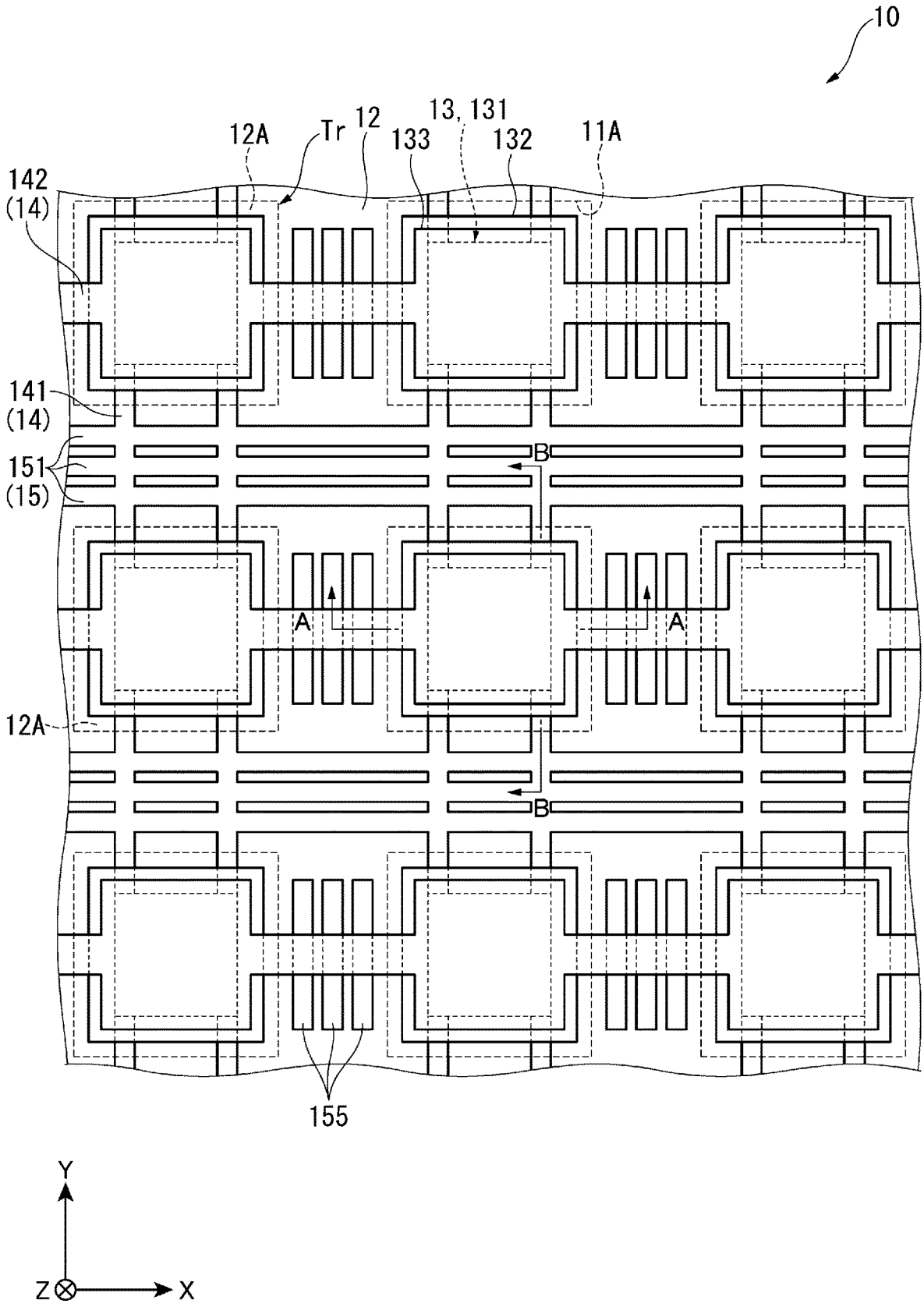
FIG. 2 is a plan view showing a part of an ultrasonic sensor of the first embodiment.
Figure 3:
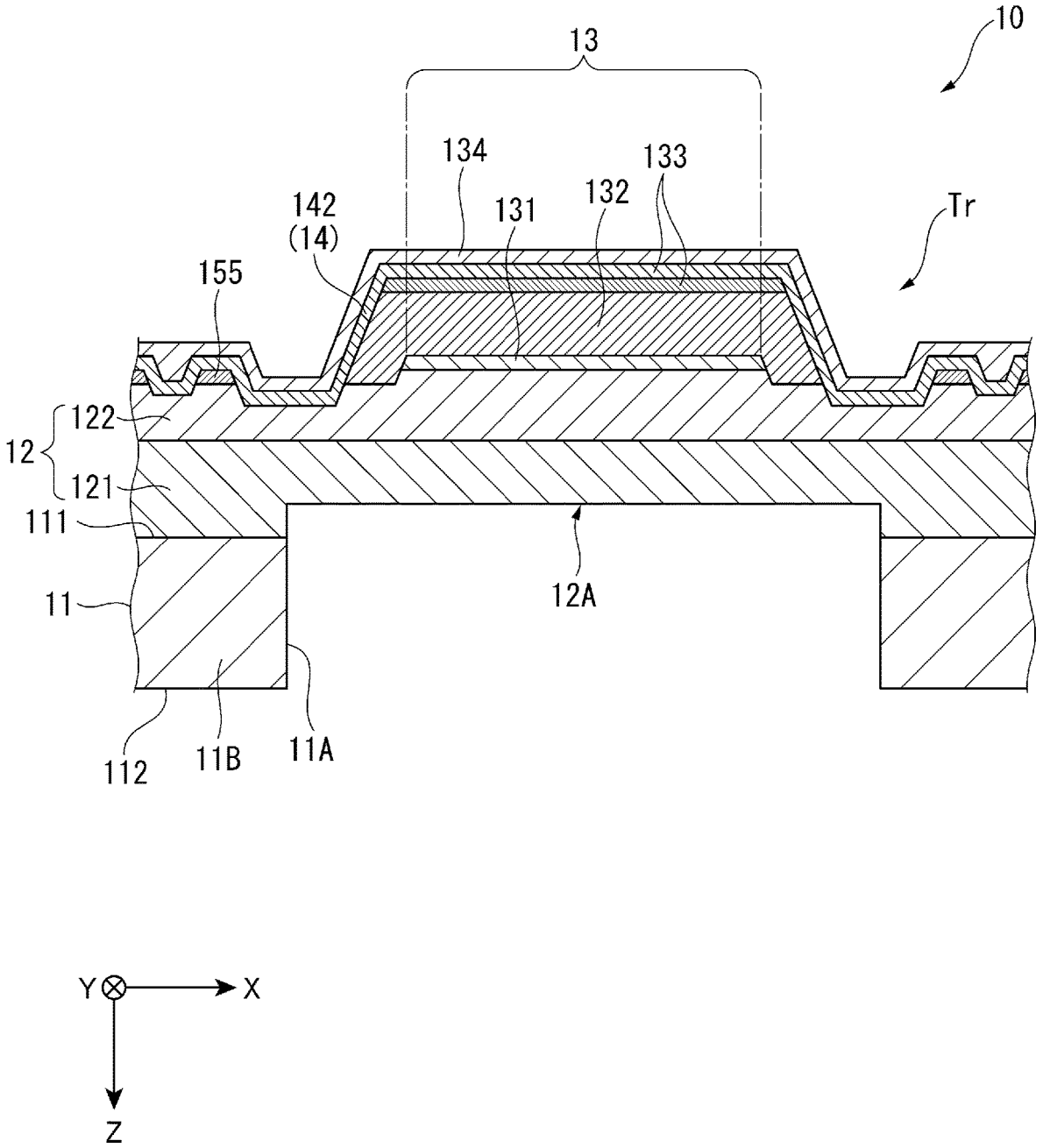
FIG. 3 is a sectional view of the ultrasonic sensor cut along line A-A in FIG. 2.
Figure 4:
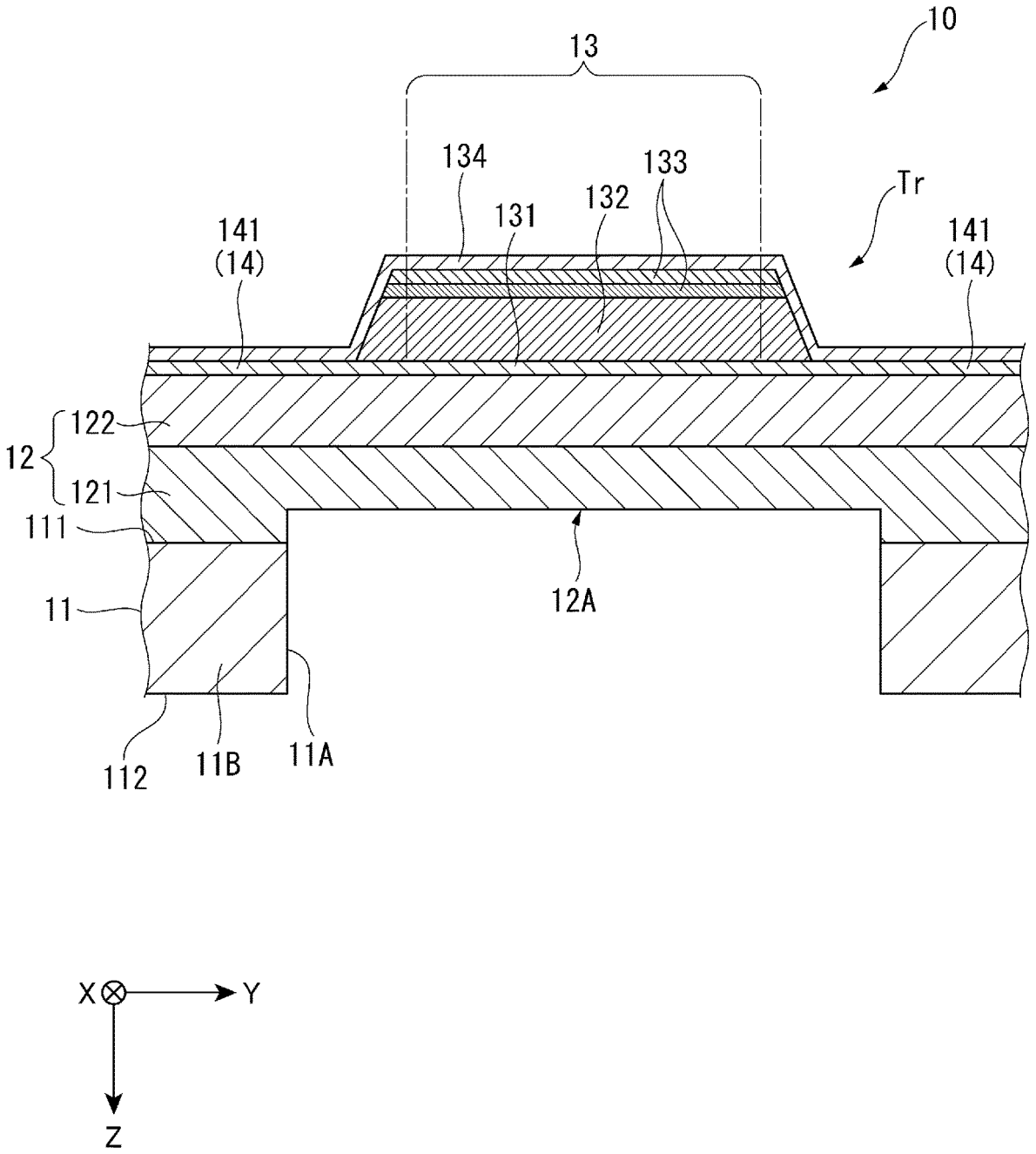
FIG. 4 is a sectional view of the ultrasonic sensor cut along line B-B in FIG. 2.

FIG. 2 is the plan view showing the part of the ultrasonic sensor 10. FIG. 3 is the sectional view of the ultrasonic sensor 10 cut along line A-A in FIG. 2. FIG. 4 is the sectional view of the ultrasonic sensor 10 cut along line B-B in FIG. 2.

As shown in FIG. 3, the ultrasonic sensor 10 includes a substrate 11, a vibrating plate 12, a piezoelectric element 13, and wiring electrodes 14. Further, as shown in FIG. 2, the ultrasonic sensor 10 includes bypass electrodes 15 coupled to the wiring electrodes 14.

Configuration of Substrate 11

The substrate 11 is a plate formed using a semiconductor substrate of Si or the like and having a predetermined thickness for supporting the vibrating plate 12. The substrate 11 has a first surface 111 and a second surface 112 in a front-back relation with the first surface 111. Here, in the following explanation, a direction from the first surface 111 toward the second surface 112 is referred to as "Z direction", a direction orthogonal to the Z direction is referred to as "X direction", and a direction orthogonal to the X direction and the Z direction is referred to as "Y direction". The first surface 111 and the second surface 112 are surfaces parallel to the XY-plane.

Opening portions 11A penetrating from the first surface 111 to the second surface 112 along the Z direction are provided in the substrate 11. A plurality of the opening portions 11A are provided along the X direction and the Y direction. That is, the opening portions 11A are arranged in a two-dimensional array form in the substrate 11.

The vibrating plate 12 is provided at the first surface 111 sides of the opening portions 11A. Of the substrate 11, parts without the opening portions 11A form wall portions 11B and the vibrating plate 12 is stacked and supported on the wall portions 11B.

Configuration of Vibrating Plate 12

The vibrating plate 12 is formed using e.g. $SiO_2$, a stacking structure of $SiO_2$ and $ZrO_2$, or the like. In the example shown in FIGS. 3 and 4, the vibrating plate 12 is formed using a stacking structure of $SiO_2$ and $ZrO_2$, and includes a first vibrating plate 121 placed at the substrate 11 side and a second vibrating plate 122 placed on the first vibrating plate 121 at an opposite side to the substrate 11.

The thickness of the vibrating plate 12 along the Z direction is sufficiently smaller than the thickness of the substrate 11. The vibrating plate 12 is supported by the wall portions 11B of the substrate 11 forming the opening portions 11A, and thereby, as described above, closes the −Z sides of the opening portions 11A. Of the vibrating plate 12, the parts overlapping with the opening portions 11A in a plan view as seen from the Z direction, i.e., the parts closing the opening portions 11A form vibrating portions 12A. The vibrating portions 12A of the vibrating plate 12 are surrounded by the wall portions 11B, and the outer edges of the vibrating portions 12A are defined by the opening portions 11A. The vibrating portions 12A serve as vibrating regions that can vibrate by the piezoelectric element 13. Note that, in the following explanation, the plan view as seen from the Z direction is simply referred to as "plan view".

Configuration of Piezoelectric Element 13

On the −Z side surface of the vibrating plate 12, first electrodes 131, the wiring electrodes 14, and the bypass electrodes 15 are provided. Further, on the −Z sides of the first electrodes 131, piezoelectric materials 132 are provided. Furthermore, on the −Z sides of the piezoelectric materials 132, second electrodes 133 are provided.

Here, as shown in FIG. 2, the first electrodes 131 are provided in center parts of the vibrating portions 12A and have rectangular shapes in the plan view.

Further, the piezoelectric materials 132 are provided to cover the entire −Z side surfaces of the first electrodes 131 and parts along the outer peripheral edges of the piezoelectric materials 132 are located on the vibrating plate 12. That is, the first electrodes 131 are placed inside of the outer peripheral edges of the piezoelectric materials 132 in the plan view.

Those piezoelectric materials 132 are formed by repeated application and firing of piezoelectric materials onto the vibrating plate 12, formation of a piezoelectric film having a predetermined thickness, and patterning by etching. Therefore, as shown in FIGS. 3 and 4, the parts along the outer peripheral edges of the piezoelectric materials 132 are tapered surfaces inclined like mountainsides. Of the −Z side surfaces of the piezoelectric materials 132, the other parts than the tapered surfaces form piezoelectric material upper surfaces substantially parallel to the XY-plane. As shown in FIGS. 3 and 4, the outer peripheral edges of the piezoelectric material upper surfaces are located outside of the outer peripheral edges of the first electrodes 131. That is, the first electrodes 131 are placed inside of the outer peripheral edges of the piezoelectric material upper surfaces in the plan view.

The second electrodes 133 are provided on the piezoelectric material upper surfaces of the piezoelectric materials 132. That is, in the embodiment, in the plan view, the second electrodes 133 are larger than the first electrodes 131, and the first electrodes 131 are placed inside of the outer peripheral edges of the second electrodes 133. Note that, in FIGS. 3 and 4, an example of the second electrode 133 formed by two layers is shown, however, the second electrode may be formed by a single layer.

In the above described configuration, in the plan view, the piezoelectric element 13 is formed by apart in which the first electrode 131, the piezoelectric material 132, and the second electrode 133 overlap. That is, the piezoelectric element 13 of the embodiment refers to an active part in which the piezoelectric material 132 is driven when a voltage is applied to the first electrode 131 and the second electrode 133.

In the embodiment, the first electrode 131 is smaller than the piezoelectric material 132 and the second electrode 133, and placed inside of the outer peripheral edge of the piezoelectric material 132 and the outer peripheral edge of the second electrode 133. Therefore, the entire first electrode 131, a part of the piezoelectric material 132 overlapping with the first electrode 131 in the plan view, and a part of the second electrode 133 overlapping with the first electrode 131 in the plan view form the piezoelectric element 13.

Here, one ultrasonic transducer Tr is formed by the single vibrating portion 12A in the vibrating plate 12 and the piezoelectric element 13 provided on the vibrating portion 12A. In the embodiment, as shown in FIG. 2, the piezoelectric elements 13 are placed for the respective vibrating portions 12A. That is, in the ultrasonic sensor 10, a plurality of the ultrasonic transducers Tr are placed along the X direction and the Y direction.

In the ultrasonic transducer Tr having the above described configuration, a voltage is applied between the first electrode 131 and the second electrode 133, and thereby, the piezoelectric element 13 expands and contracts and the vibrating portion 12A of the vibrating plate 12 with the piezoelectric element 13 provided thereon vibrates at a frequency according to the opening width of the opening portion 11A or the like. Thereby, ultrasonic wave is transmitted from the +Z side of the vibrating portion 12A.

Or, when ultrasonic wave is input to the opening portion 11A, the vibrating portion 12A vibrates by the ultrasonic wave and a potential difference is produced between the upside and the downside of the piezoelectric material 132. Therefore, the potential difference produced between the first electrode 131 and the second electrode 133 is detected, and thereby, the ultrasonic wave can be detected (received).

Further, in the embodiment, as shown in FIGS. 3 and 4, a protective film 134 covering the piezoelectric element 13 is provided. The protective film 134 is a film that protects the second electrode 133 and parts not covered by a second wiring electrode 142, which will be described later, coupled to the second electrode 133 of the −Z side surface of the piezoelectric material 132. The piezoelectric material 132 is covered by the second electrode 133, the second wiring electrode 142, and the protective film 134, and thereby, breakage such as cracking of the piezoelectric material 132 can be suppressed.

Configurations of Wiring Electrode 14 and Bypass Electrode 15

Figure 5:
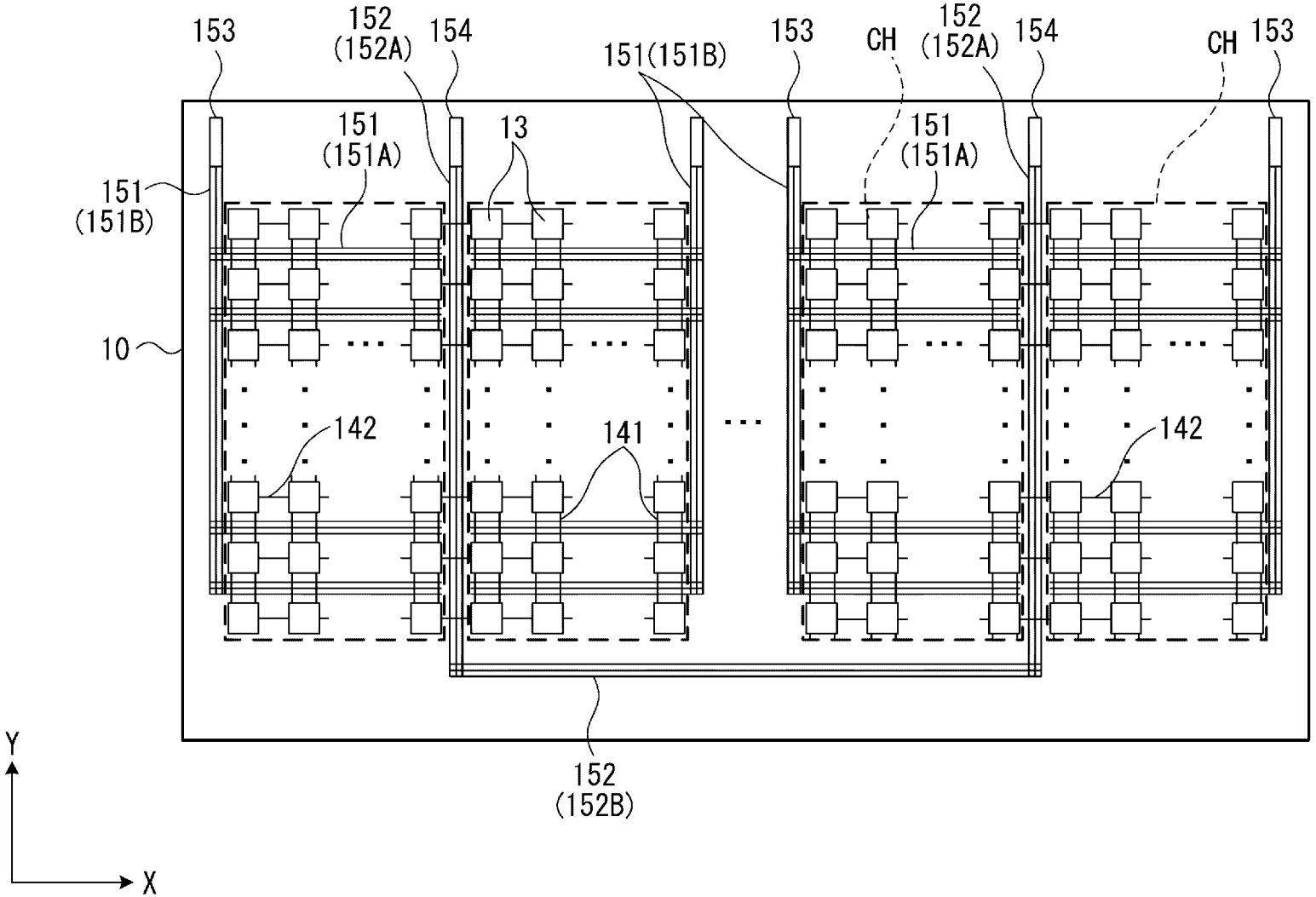
FIG. 5 is a plan view showing an example of a wiring configuration of the ultrasonic sensor of the first embodiment.

FIG. 5 shows the example of the wiring configuration of the ultrasonic sensor 10.

As shown in FIGS. 2 and 5, the wiring electrode 14 includes a first wiring electrode 141 coupled to the first electrode 131 and the second wiring electrode 142 coupled to the second electrode 133.

The bypass electrode 15 is an electrode coupled to the wiring electrode 14 and coupling the piezoelectric element 13 to the drive circuit 30. Specifically, the bypass electrode 15 includes a first bypass electrode 151 coupled to the first wiring electrode 141 and a second bypass electrode 152 coupled to the second wiring electrode 142.

The first wiring electrode 141 is a coupling electrode coupled to the piezoelectric element 13, coupled to the first electrode 131, and extended from a position overlapping with the opening portion 11A in the plan view to a position not overlapping with the opening portion 11A, i.e., a position overlapping with the wall portion 11B. More specifically, in the embodiment, the first wiring electrode 141 is elongated along the Y direction and couples the first electrodes 131 arranged in the Y direction. In the embodiment, two of the first wiring electrodes 141 are provided between the two first electrodes 131 arranged in the Y direction, and respectively couple corner portions of the first electrodes 131.

As below, coupling positions of the first wiring electrodes 141 to the first electrode 131 will be explained further in detail according to FIG. 6.

Figure 6:
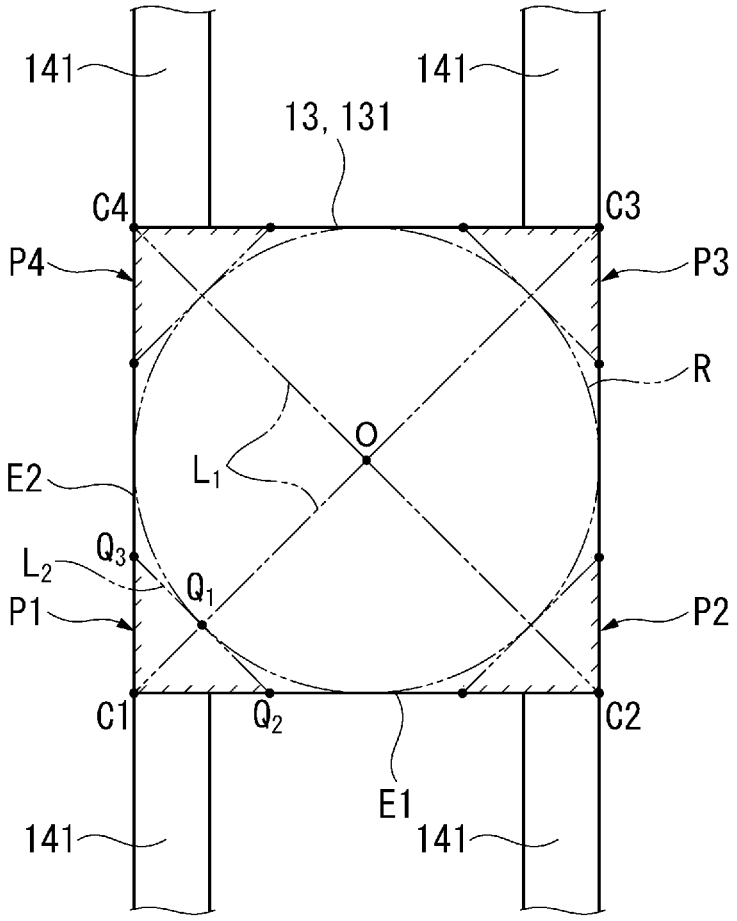
FIG. 6 is a plan view for explanation of coupling positions of first wiring electrodes to a piezoelectric element of the first embodiment.
Figure 6:
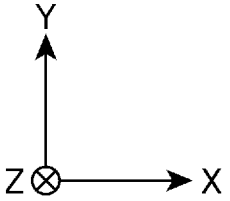

FIG. 6 is the plan view for explanation of the coupling positions of the first wiring electrodes 141 to the piezoelectric element 13.

In FIG. 6, O is a point of the center of gravity of the piezoelectric element 13 in the plan view. R is a virtual circle inscribed in the respective sides of the piezoelectric element 13. Further, an intersection point of a first virtual line $L_1$ connecting one corner portion C1 and the point of the center of gravity O of the piezoelectric element 13 with the virtual circle R is a first intersection point $Q_1$, and a tangent line of the virtual circle R at the first intersection point $Q_1$ is a second virtual line $L_2$.

Furthermore, two sides of the piezoelectric element 13 with the corner portion C1 in between are respectively a first line portion E1 and a second line portion E2, and an intersection point of the second virtual line $L_2$ with the first line portion E1 is a second intersection point $Q_2$ and an intersection point of the second virtual line $L_2$ with the second line portion E2 is a third intersection point $Q_3$.

Note that, in the embodiment, the first electrode 131 and the piezoelectric element 13 coincide in the plan view and the point of the center of gravity O is also the center of gravity of the first electrode 131 and the virtual circle R is also a virtual circle inscribed in the outer peripheral edge of the first electrode 131. Further, the corner portion C1 is also a corner portion of the first electrode 131 and the first line portion E1 and the second line portion E2 are also two sides with the corner portion of the first electrode 131 in between.

In the embodiment, the first wiring electrode 141 is coupled to a corner portion neighborhood range P1 from the second intersection point $Q_2$ through the corner portion C1 to the third intersection point $Q_3$ of the outer peripheral edge of the piezoelectric element 13, i.e., the outer peripheral edge of the first electrode 131.

Further, the line width of the first wiring electrode 141 in a direction orthogonal to the longitudinal direction is smaller than the width of the piezoelectric element 13 in the same direction. In the embodiment, the first wiring electrode 141 is an electrode extended along the Y direction, and the width in the X direction is the line width of the first wiring electrode 141 and smaller than the width of the piezoelectric element 13 in the X direction. It is preferable that the line width of the first wiring electrode 141 is equal to or smaller than the length of the line segment connecting the second intersection point $Q_2$ and the third intersection point $Q_3$ and equal to or larger than 10 μm.

For example, in the embodiment, as shown in FIG. 6, one of the first wiring electrodes 141 is coupled to a part between the corner portion C1 and the second intersection point $Q_2$. Further, the line width of the first wiring electrode 141 is smaller than the dimension from the corner portion C1 to the second intersection point $Q_2$.

Note that the coupling position of the first wiring electrode 141 is explained with a focus on the corner portion neighborhood range P1 containing the corner portion C1 located at the −X−Y side, and the same applies to the other corner portions C2, C3, C4 and the first wiring electrodes 141 are coupled to corresponding corner portion neighborhood ranges P2, P3, P4.

In the embodiment, in the piezoelectric element 13, when a voltage is applied between the first electrode 131 and the second electrode 133, the piezoelectric element 13 deforms the vibrating portion 12A around the point of the center of gravity O at the center. That is, in FIG. 6, the piezoelectric element 13 deforms in the same amount of deformation at the respective points on the virtual circle R, and the amount of deformation outside the virtual circle R is smaller than those at the respective points on the virtual circle R. Therefore, in the corner portion neighborhood ranges P1 to P4, the amounts of deformation are smaller than those at the midpoints of the respective sides of the piezoelectric element 13. Accordingly, the first wiring electrodes 141 are coupled to the corner portion neighborhood ranges P1 to P4, and thereby, for example, compared to the case where the first wiring electrodes 141 are coupled to vicinities of the midpoints of the respective sides of the piezoelectric element 13, the amounts of deformation of the first wiring electrodes 141 when the piezoelectric element 13 deforms are smaller and disconnection of the first wiring electrodes 141 due to deformation can be suppressed.

Returning to FIG. 5, the first bypass electrode 151 will be explained.

The first bypass electrode 151 includes first coupling portion 151A formed to be longitudinal along the X direction in positions overlapping with the wall portions 11B and first connecting portion 151B placed along the Y direction in positions overlapping with the wall portions 11B in the plan view.

In the embodiment, as described above, the respective first electrodes 131 of the piezoelectric elements 13 arranged in the Y direction are coupled by the first wiring electrodes 141 at the same potential. Therefore, when these respective piezoelectric elements 13 arranged in the Y direction form a single piezoelectric element column, in the embodiment, a plurality of the piezoelectric element columns are arranged in the X direction. The first coupling portions 151A of the first bypass electrode 151 are coupled to the first wiring electrodes 141 of a predetermined number of piezoelectric element columns as shown in FIG. 6. When n piezoelectric elements 13 are provided along the Y direction in the single piezoelectric element column and m piezoelectric element columns are coupled by the first bypass electrodes 151, the first electrodes 131 of the m×n piezoelectric elements 13 are at the same potential and the ultrasonic transducers Tr containing these piezoelectric elements 13 form a single channel CH. Accordingly, in the embodiment, as shown in FIG. 5, the ultrasonic sensor 10 has a structure in which a plurality of the channels CH are placed in a one-dimensional array structure along the X direction.

Further, the first connecting portion 151B is placed at the +X side or −X side in each channel CH and connects the respective first coupling portions 151A. For example, as shown in FIG. 5, the first coupling portions 151A of the channel CH placed in the odd-numbered position along the X direction are connected by the first connecting portion 151B placed at the −X side of the channel CH. The first coupling portions 151A of the channel CH placed in the even-numbered position along the X direction are connected by the first connecting portion 151B placed at the +X side of the channel CH. These first connecting portions 151B are coupled to respectively corresponding drive terminals 153 and coupled to the drive circuit 30 via the drive terminals 153. Thereby, respectively independent drive signals can be input from the drive circuit 30 to the respective channels CH, and reception signals output from the respective channels can be respectively independently detected.

On the other hand, the second wiring electrode 142 is an electrode coupled to the outer peripheral edges of the second electrodes 133, and, as shown in FIG. 2, extended from a position overlapping with the opening portion 11A in the plan view to a position not overlapping with the opening portion 11A, i.e., a position overlapping with the wall portion 11B. In the embodiment, the second wiring electrode 142 is placed along the X direction and couples the second electrodes 133 arranged in the X direction within the same channel CH.

Further, the second wiring electrode 142 is coupled to center parts in the sides at the ±X sides of the second electrodes 133 and the line width as a width in the Y direction is equal to or smaller than the width of the second electrode 133 in the Y direction.

That is, in the embodiment, the outer peripheral edge of the second electrode 133 is located outside of the outer peripheral edge of the piezoelectric element 13, and thus, the amounts of deformation at the respective points of the outer peripheral edge of the second electrode 133 are smaller than the amounts of deformation at the respective points of the outer peripheral edge (outline) of the piezoelectric element 13 when a voltage is applied to the piezoelectric element 13. Therefore, even when the second wiring electrode 142 is coupled to the center parts of the sides of the second electrode 133, the second wiring electrode 142 is not disconnected.

The second bypass electrode 152 is provided in a position overlapping with the wall portions 11B in the plan view. Further, the second bypass electrode 152 includes a second coupling portion 152A formed to be longitudinal along the Y direction and a second connecting portion 152B placed as shown in FIG. 5.

As shown in FIG. 5, the second coupling portion 152A is placed between the odd-numbered channel CH and the even-numbered channel CH, and coupled to the second wiring electrodes 142 placed in the two channels CH placed with the second coupling portion 152A in between.

Further, the second connecting portion 152B is provided at the opposite side to the side at which the drive terminals 153 and common terminals 154 are placed, and connects all of the second coupling portions 152A.

That is, in the embodiment, the second electrodes 133 of all piezoelectric elements 13 of the ultrasonic sensor 10 are at the same potential. Further, the second bypass electrodes 152 are coupled to the drive circuit 30 via the common terminals 154, and the respective second electrodes 133 are maintained at a predetermined reference potential by the drive circuit 30.

The above described first bypass electrodes 151 and second bypass electrodes 152 are placed in positions overlapping with the wall portions 11B with a plurality of the electrodes as one set. For example, in FIGS. 2 and 5, three first bypass electrodes 151 as one set form a bundle of electrodes and three second bypass electrodes 152 as one set form a bundle of electrodes. It is preferable that the dimension between the first bypass electrodes 151 forming the bundle of electrodes and the dimension between the second bypass electrodes 152 are equal to or larger than 5 μm and equal to or smaller than the line width of the first wiring electrode 141.

The line width of each first bypass electrode 151 forming the bundle of electrodes and the line width of each second bypass electrode 152 forming the bundle of electrodes are formed to be the same width as the line width of the first wiring electrode 141.

Note that, though the detailed illustration is omitted, Au wires are placed on the respective three first bypass electrodes 151 as one set and respective three second bypass electrodes 152 as one set. The three electrodes are covered by the Au wires, and thereby, electrical resistance in the bypass electrodes 15 can be reduced and attenuation of signal voltages can be suppressed. In FIGS. 2 and 5, illustration of the Au wires covering the bundles of electrodes is omitted.

In the embodiment, in the respective channels CH, protective electrodes 155 are placed with a plurality of the electrodes as one set like the first bypass electrodes 151 and the second bypass electrodes 152 in positions overlapping with the wall portions 11B between the opening portions 11A adjacent to each other in the X direction. For example, in the example shown in FIG. 2, in the plan view, three of the protective electrodes 155 parallel in the Y direction are provided respectively in the positions overlapping with the wall portions 11B between the opening portions 11A adjacent to each other in the X direction.

Configuration of Control Unit 20

The control unit 20 includes the drive circuit 30 that drives the ultrasonic sensor 10 and a calculation unit 40. Further, in addition, a memory unit that stores various kinds of data, various programs, etc. for control of the distance measuring apparatus 100 may be provided in the control unit 20.

The drive circuit 30 is a circuit board on which a driver circuit for controlling driving of the ultrasonic sensor 10 is provided, and includes e.g. a reference potential circuit 31, a switching circuit 32, a transmitting circuit 33, and a receiving circuit 34 as shown in FIG. 1.

The reference potential circuit 31 is coupled to the common terminal 154 of the ultrasonic sensor 10 and applies a reference potential to the second electrodes 133. As the reference potential, e.g. −3 V or the like may be exemplified.

The switching circuit 32 is coupled to the drive terminal 153 of the ultrasonic sensor 10, the transmitting circuit 33, and the receiving circuit 34. The switching circuit 32 includes a switching circuit and switches between transmission coupling for coupling the drive terminal 153 and the transmitting circuit 33, and reception coupling for coupling the drive terminal 153 and the receiving circuit 34.

The transmitting circuit 33 is coupled to the switching circuit 32 and the calculation unit 40 and, when the switching circuit 32 is switched to the transmission coupling, outputs drive signals in pulse waveforms to the piezoelectric elements 13 of the respective ultrasonic transducers Tr and transmits ultrasonic wave from the ultrasonic sensor 10 based on the control of the calculation unit 40.

The receiving circuit 34 is coupled to the switching circuit 32 and the calculation unit 40, to which the reception signals from the respective piezoelectric elements 13 are input when the switching circuit 32 is switched to the reception coupling. The receiving circuit 34 includes e.g. a linear noise amplifier, A/D converter, etc., and performs respective signal processing of conversion of the input reception signals into digital signals, removal of noise components, amplification to desired signal levels, etc. and outputs the processed reception signals to the calculation unit 40.

The calculation unit 40 includes e.g. a CPU (Central Processing Unit) or the like, and controls the ultrasonic sensor 10 via the drive circuit 30 and performs transmission and reception processing of ultrasonic wave using the ultrasonic sensor 10.

That is, the calculation unit 40 switches the switching circuit 32 to the transmission coupling, drives the ultrasonic sensor 10 from the transmitting circuit 33, and performs transmission processing of ultrasonic wave. Further, the calculation unit 40 switches the switching circuit 32 to the reception coupling immediately after the transmission of ultrasonic wave, and receives the reflected wave reflected by an object by the ultrasonic sensor 10. Then, the calculation unit 40 calculates a distance from the ultrasonic sensor 10 to the object by the ToF (Time of Flight) method using e.g. a time from a transmission time at which the ultrasonic wave is transmitted from the ultrasonic sensor 10 to the reception of the reception signal and the acoustic velocity in the air.

Manufacturing Method of Ultrasonic Sensor

Next, a manufacturing method of the ultrasonic sensor 10 of the embodiment will be explained.

Figure 7:
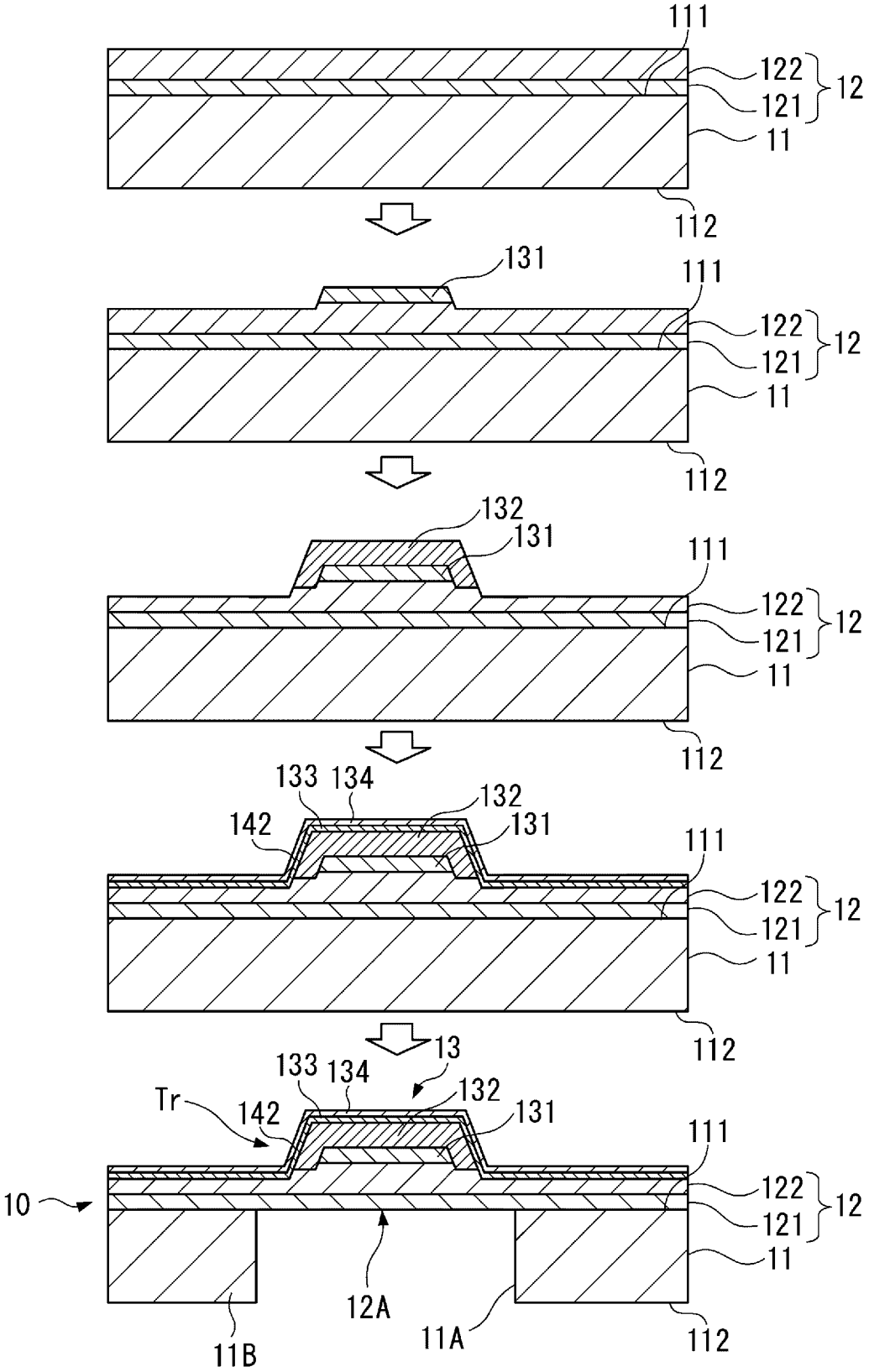
FIG. 7 shows respective steps for manufacturing the ultrasonic sensor of the first embodiment.

FIG. 7 shows the respective steps for manufacturing the ultrasonic sensor 10.

In the manufacture of the ultrasonic sensor 10, first, a base material substrate for formation of the substrate 11 and the vibrating plate 12 is prepared. The base material substrate is a parallel plate having parallel two flat surfaces and formed using Si.

Then, one of the parallel two flat surfaces of the base material substrate is thermally oxidized. Thereby, the thermally oxidized one surface becomes the first vibrating plate 121 formed by $SiO_2$, and the unoxidized residual part becomes the substrate 11. A boundary between the substrate 11 and the first vibrating plate 121 becomes the first surface 111. Further, a Zr film is formed on the first vibrating plate 121, thermally oxidized, and the second vibrating plate 122 of $ZrO_2$ is formed. Thereby, as shown by the first step in FIG. 7, the vibrating plate 12 is formed on the substrate 11.

Then, a conducting member is stacked on the vibrating plate 12. The conducting member is not particularly limited, but a metal material, metal alloy material, conductive oxide, or the like may be used. Further, a plurality of materials may be layered as the conducting member and, in the embodiment, a layered electrode of Ir and Ti is formed.

Then, a mask pattern for formation of the first electrode 131, the first wiring electrode 141, the first bypass electrode 151, the second bypass electrode 152, and the protective electrode 155 is formed on the conducting member and, as shown by the second step in FIG. 7, the respective electrodes are patterned by etching. The first electrode 131, the first wiring electrode 141, the first bypass electrode 151, the second bypass electrode 152, and the protective electrode 155 are formed using the same material at the same time. As shown by the second step in FIG. 7, the first electrode 131, the first wiring electrode 141, the first bypass electrode 151, the second bypass electrode 152, and the protective electrode 155 are formed. Note that, in FIG. 7, only the first electrode 131 is shown, but the illustration of the first wiring electrode 141, the first bypass electrode 151, the second bypass electrode 152, and the protective electrode 155 is omitted.

Note that, in this regard, it is preferable to stop etching on the surface of the second vibrating plate 122, however, actually, as shown by the second step in FIG. 7, the part with no electrode placed thereon is slightly etched. Here, in the embodiment, the protective electrode 155 is formed in the part with no bypass electrode 15 or first wiring electrode 141 formed thereon of the parts overlapping with the wall portions 11B in the plan view. Thereby, inconvenience of excessive etching of the second vibrating plate 122 is suppressed.

Then, the piezoelectric material 132 is formed on the vibrating plate 12. For the piezoelectric material 132, a piezoelectric material of transition metal oxide having a perovskite structure or the like may be used, and PZT is used in the embodiment. Specifically, an application step of applying a PZT solution to cover the vibrating plate 12 using a solution technique and a firing step of firing the applied PZT solution are performed at a plurality of times, and thereby, a piezoelectric material layer having a predetermined thickness is formed.

Then, a mask pattern for formation of the piezoelectric material 132 is formed on the piezoelectric material layer and, as shown by the third step in FIG. 7, patterned by etching.

Here, the bypass electrode 15 coupling the wiring electrode 14 coupled to the piezoelectric element 13 and the terminal part (the drive terminal 153 and the common electrode 154) tends to be longer in wiring distance. Accordingly, in related art, the line width of the bypass electrode is made larger than that of the wiring electrode to suppress increase in electrical resistance. In this regard, it is preferable that the line width of the wiring electrode coupled to the piezoelectric element 13 and placed over inside and outside of the vibrating portion 12A is made as small as possible to reduce the influence on the vibration of the vibrating portion 12A. Further, the length of the wiring electrode is shorter and, even when the line width is made smaller and the electrical resistance increases, the influence on driving of the piezoelectric element 13 is smaller. Therefore, in related art, the electrode pattern is formed so that the line width of the wiring electrode may be made smaller than the line width of the bypass electrode.

If PZT is left in the bypass electrode 15, particularly, conduction may be lost due to coupling failure between the second bypass electrode 152 and the second wiring electrode 142. Accordingly, at the step of patterning the piezoelectric material 132 by etching, it is necessary to take a sufficient time for etching so that PZT may not be left on the bypass electrode 15.

However, when the line width of the bypass electrode is made larger than the line width of the wiring electrode as in related art, the etching rate of PZT on the wiring electrode is faster than the etching rate of PZT on the bypass electrode. Accordingly, the PZT on the wiring electrode is removed earlier than the PZT on the bypass electrode. Therefore, when etching is continued until the PZT on the bypass electrode is completely removed, the wiring electrode is inconveniently etched. In this case, the wiring electrode may be disconnected.

On the other hand, in the embodiment, as described above, the first bypass electrodes 151 and the second bypass electrodes 152 having the same line width as those of the first wiring electrodes 141 are formed and the bundles of electrodes with the three first bypass electrodes 151 as one set and the three second bypass electrodes 152 as one set are formed.

Accordingly, the etching rate of PZT on the first wiring electrode 141, the etching rate of PZT on the first bypass electrodes 151, and the etching rate of PZT on the second bypass electrodes 152 are the same. Therefore, the inconvenience of etching of the first wiring electrode 141 by excessive etching is suppressed and disconnection of the first wiring electrode 141 is suppressed. Note that the part with no electrode formed thereon of the second vibrating plate 122 is slightly etched as shown by the third step in FIG. 7.

As described above, the piezoelectric material 132 is patterned, then, the conducting member is formed on the vibrating plate 12, the mask pattern for formation of the second electrode 133 and the second wiring electrode 142 is formed, and the second electrode 133 and the second wiring electrode 142 are formed by etching.

Further, though not shown, the Au electrodes are formed on the three first bypass electrodes 151 as one set and the three second bypass electrodes 152 as one set, and the respective bypass electrodes 15 are reinforced by the Au electrodes.

Furthermore, the protective film 134 covering the piezoelectric element 13 is formed. Thereby, as shown by the fourth step in FIG. 7, formation of the basic structure containing the piezoelectric element 13 on the vibrating plate 12 is completed.

Then, the second surface 112 at the opposite side to the first surface 111 of the substrate 11 is cut and polished into a desired thickness and a mask pattern for formation of the opening portion 11A in the second surface 112 is formed, and the opening portion 11A is formed by etching using the first vibrating plate 121 of $SiO_2$ as an etching stopper. Thereby, as shown by the fifth step in FIG. 7, the ultrasonic sensor 10 is manufactured.

Functions and Effects of Embodiment

The distance measuring apparatus 100 of the embodiment includes the ultrasonic sensor 10 and the control unit 20 that controls the ultrasonic sensor 10. Further, the ultrasonic sensor 10 includes the substrate 11 having the opening portions 11A penetrating from the first surface 111 to the second surface 112, the vibrating plate 12 provided on the substrate 11 to close the opening portions 11A, and the piezoelectric elements 13 provided on the vibrating plate 12 in the positions overlapping with the opening portions 11A in the plan view. Furthermore, the first wiring electrodes 141 as the coupling electrodes extended from the positions overlapping with the opening portions 11A to the positions not overlapping with the opening portions 11A and having the line widths smaller than the widths of the piezoelectric elements 13 are coupled to the piezoelectric elements 13.

In the embodiment, the piezoelectric element 13 is formed in the rectangular shape in the plan view and has the outline containing the corner portion C1 and the first line portion E1 and the second line portion E2 with the corner portion C1 in between. The first wiring electrode 141 is coupled to the corner portion neighborhood range P1 from the second intersection point $Q_2$ through the corner portion C1 to the third intersection point $Q_3$ in the outline of the piezoelectric element 13.

The corner portions C1 to C4 in the piezoelectric element 13 are singularities where the piezoelectric element 13 is least likely to deform when the drive voltage is applied to the piezoelectric element 13. In the embodiment, the first wiring electrodes 141 are provided in the corner portion neighborhood ranges P1 to P4 around the singularities, and thus, the first wiring electrodes 141 are unlikely to deform when the drive voltage is applied to the piezoelectric element 13 and breakage of the first wiring electrodes 141 is suppressed. Thereby, the ultrasonic sensor 10 with higher wiring reliability may be obtained. Therefore, reliability in the distance measuring apparatus 100 including the ultrasonic sensor 10 is improved.

In the embodiment, the piezoelectric element 13 includes the first electrode 131, the piezoelectric material 132 covering the first electrode 131, and the second electrode 133 provided on the piezoelectric material 132 at the opposite side to the first electrode 131, and the first electrode 131 is provided inside of the outer peripheral edge of the second electrode 133 in the plan view. Therefore, the piezoelectric element 13 is formed by the entire first electrode 131, a part of the piezoelectric material 132 overlapping with the first electrode 131 in the plan view, and a part of the second electrode 133 overlapping with the first electrode 131 in the plan view.

In the configuration, the second electrode 133 covers a part of the piezoelectric material 132, and thus, the piezoelectric material 132 exposed to outside in a smaller region and it is only necessary to provide the protective film 134 to cover the exposed region. The configuration may be simplified.

Here, the entire first electrode 131 forms the piezoelectric element 13, and the outer peripheral edge of the first electrode 131 coincides with the outer peripheral edge of the piezoelectric element 13 in the plan view. In the configuration, when the drive voltage is applied to the piezoelectric element 13, the amount of deformation of the first electrode 131 is larger, however, breakage of the first wiring electrodes 141 may be suppressed because the first wiring electrodes 141 are coupled to the corner portion neighborhood ranges P1 to P4 as described above.

The ultrasonic sensor 10 of the embodiment includes the drive terminal 153, the common terminal 154, the first bypass electrode 151 that couples the drive terminal 153 and the first wiring electrode 141, and the second bypass electrode 152 that couples the common terminal 154 and the second wiring electrode 142. The line widths of the first bypass electrode 151 and the second bypass electrode 152 are formed to be the same width as the line width of the first wiring electrode 141.

In the configuration, disconnection of the first wiring electrode 141 in the manufacturing of the ultrasonic sensor 10 may be suppressed. That is, when the thin-film type piezoelectric element 13 is formed on the vibrating plate 12 like the ultrasonic sensor 10 of the embodiment, usually, the first electrode 131, the first wiring electrode 141, and the bypass electrode 15 are formed, then, the piezoelectric material layer is formed to cover these electrodes, and the piezoelectric material 132 is formed by etching of the piezoelectric material layer. In the formation, it is necessary to etch the piezoelectric material layer so that the piezoelectric material layer may not be left in a part of the first wiring electrode 141 and the bypass electrode 15. Here, when the line width of the bypass electrode 15 is larger than that of the first wiring electrode 141, the piezoelectric material layer on the first wiring electrode 141 is removed earlier. Therefore, when etching is continued until the piezoelectric material layer on the bypass electrode 15 is removed, part of the first wiring electrode 141 is also removed by the etching and the line width of the first wiring electrode 141 becomes thinner and the electrode may be disconnected. On the other hand, in the embodiment, the piezoelectric material layers on the first wiring electrode 141 and the bypass electrode 15 may be removed substantially at the same time and inconvenience of thinner line width and disconnection of the first wiring electrode 141 may be suppressed.

Second Embodiment

In the above described first embodiment, the example in which the first electrode 131 is provided inside of the outer peripheral edge of the piezoelectric material 132 and the peripheral edge of the second electrode 133 and the entire first electrode 131 forms a part of the piezoelectric element 13 is shown.

On the other hand, the second embodiment is different from the first embodiment in that the first electrode is larger than the second electrode and the second electrode is provided inside of the outer peripheral edge of the first electrode.

Figure 8:
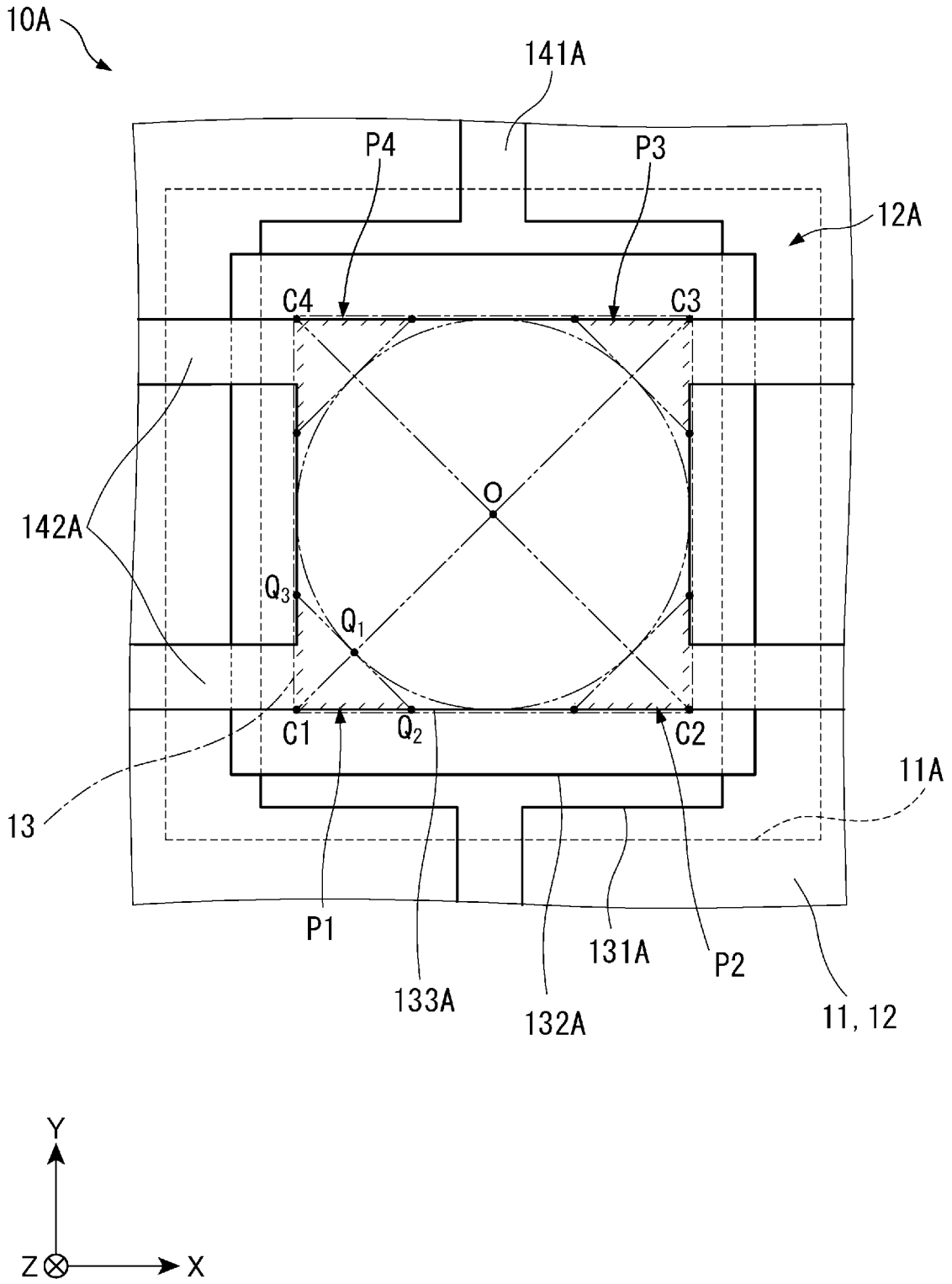
FIG. 8 is a partially enlarged plan view of an ultrasonic sensor according to a second embodiment.

FIG. 8 is the partially enlarged plan view of a part of an ultrasonic sensor 10A according to the second embodiment. Note that, in the following description, the same configurations as those of the previously described items have the same signs and the explanation thereof will be omitted or simplified.

As shown in FIG. 8, in the embodiment, like the ultrasonic sensor 10 of the first embodiment, the substrate 11 having the opening portions 11A, the vibrating plates 12, and the piezoelectric elements 13 are provided.

Like the first embodiment, the piezoelectric element 13 of the embodiment is also formed by a part in which a first electrode 131A, a piezoelectric material 132A, and a second electrode 133A overlap in the plan view.

Here, in the embodiment, the first electrode 131A has larger widths with respect to the X direction and the Y direction than the first electrode 131 in the first embodiment.

Further, the piezoelectric material 132A has a larger width with respect to the X direction than the first electrode 131A. Therefore, the −X side end portion of the piezoelectric material 132A is located closer to the −X side than the −X side end portion of the first electrode 131A, and the +X side end portion of the piezoelectric material 132A is located closer to the +X side than the +X side end portion of the first electrode 131A.

On the other hand, in the embodiment, the piezoelectric material 132A has a smaller width with respect to the Y direction than the first electrode 131A and located inside of the ±Y end portions of the first electrode 131A. That is, the −Y side end portion of the piezoelectric material 132A is located closer to the +Y side than the −Y side end portion of the first electrode 131A, and the +Y side end portion of the piezoelectric material 132A is located closer to the −Y side than the +Y side end portion of the first electrode 131A.

Note that, here, the example in which the width of the piezoelectric material 132A is smaller than that of the first electrode 131A with respect to the Y direction is shown, however, the configuration is not limited to that. For example, like the first embodiment, the piezoelectric material 132A may be provided to cover the entire first electrode 131A.

The second electrode 133A of the embodiment is smaller than the first electrode 131A and placed inside of the outer peripheral edge of the first electrode 131A in the plan view.

Therefore, in the embodiment, the entire second electrode 133A, a part of the first electrode 131A, and a part of the piezoelectric material 132A overlap in the plan view and form the piezoelectric element 13.

Further, in the embodiment, the coupling electrodes coupled to the piezoelectric material 132 are second wiring electrodes 142A coupled to the second electrode 133A. Like the first wiring electrodes 141 in the first embodiment, the second wiring electrodes 142A are coupled to the corner portion neighborhood ranges P1 to P4 within predetermined ranges from the corner portions C1 to C4 of the piezoelectric element 13.

On the other hand, a first wiring electrode 141A in the embodiment is an electrode coupled to the outer peripheral edge of the first electrode 131A. The first wiring electrode 141A is coupled to center parts in the sides at the ±Y sides of the first electrode 131A.

The line width of the first wiring electrode 141A is the same as that of the first embodiment and preferably equal to or larger than 10 μm and equal to or smaller than the length of the line segment connecting the second intersection point $Q_2$ and the third intersection point $Q_3$. That is, the line width of the first wiring electrode 141A formed directly on the vibrating plate 12A is made smaller than the width in the X direction in the piezoelectric element 13, and thereby, the influence on the vibration of the vibrating portion 12A may be reduced.

Furthermore, in the embodiment, the outer peripheral edge of the first electrode 131A is located outside of the outer peripheral edge of the piezoelectric element 13, and thus, the amounts of deformation at the respective points of the outer peripheral edge of first electrode 131A are smaller than the amounts of deformation at the respective points on the outer peripheral edge (outline) of the piezoelectric element 13 when a voltage is applied to the piezoelectric element 13. Therefore, even when the first wiring electrode 141A is coupled to the center parts of the sides of the first electrode 131A and the line width thereof is made smaller, the first wiring electrode 141A is not disconnected.

In the embodiment, the same functions and effects as those of the above described first embodiment may be exerted.

That is, in the embodiment, the second wiring electrodes 142A are coupled to the corner portions C1 to C4 as singularities where the piezoelectric element 13 is least likely to deform when the drive voltage is applied to the piezoelectric element 13. Thus, the second wiring electrodes 142A are unlikely to deform when the drive voltage is applied to the piezoelectric element 13 and breakage of the second wiring electrodes 142A is suppressed. Thereby, the ultrasonic sensor 10A with higher wiring reliability may be obtained.

Third Embodiment

Next, the third embodiment will be explained.

In the first embodiment, the example in which the piezoelectric element 13 and the first electrode 131 coincide in the plan view and, in the second embodiment, the example in which the piezoelectric element 13 and the second electrode 133A coincide in the plan view are shown. On the other hand, in the third embodiment, both the first electrode 131 and the second electrode 133 coincide with the piezoelectric element 13 in the plan view.

Figure 9:
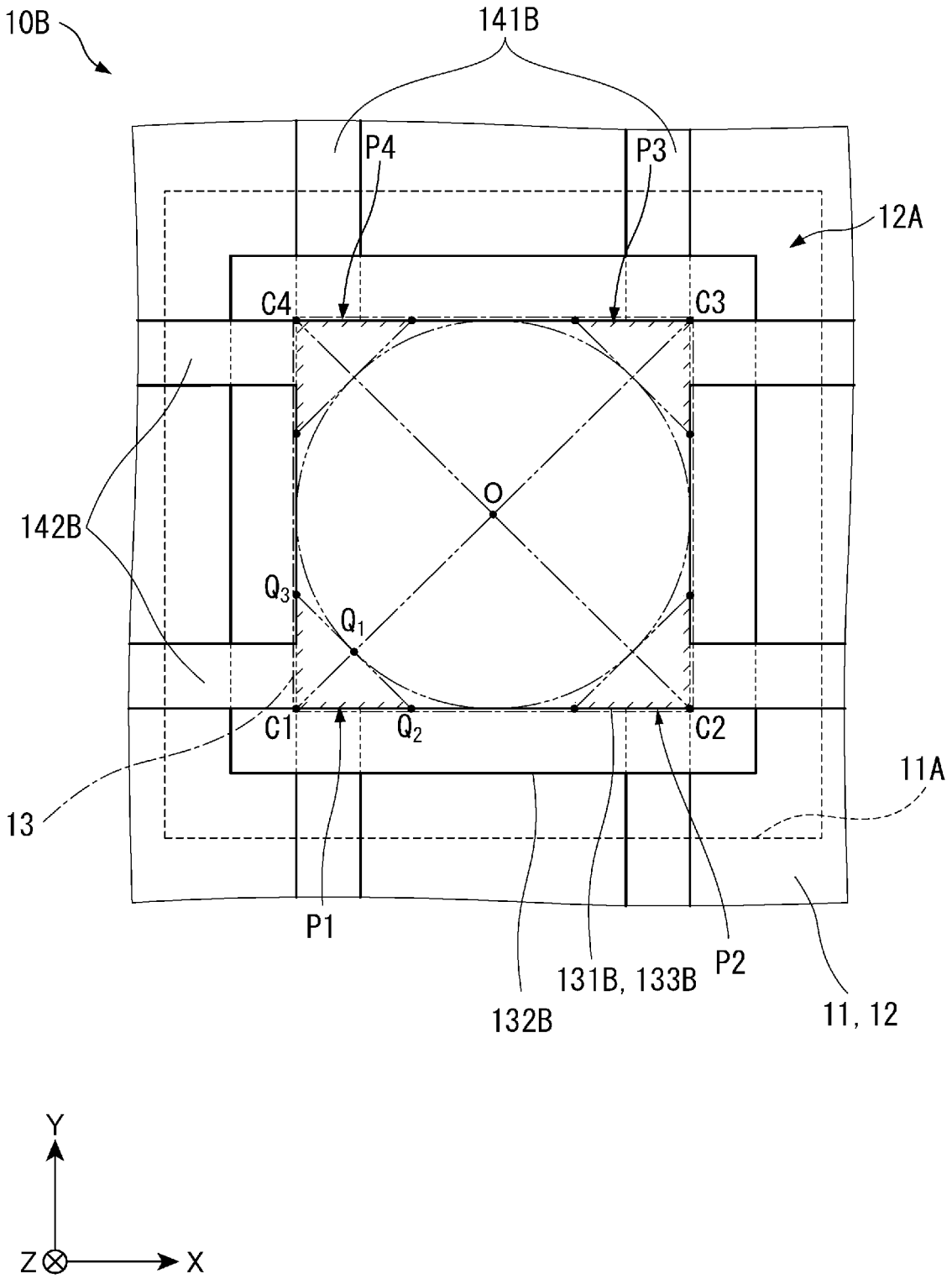
FIG. 9 is a partially enlarged plan view of an ultrasonic sensor according to a third embodiment.

FIG. 9 is the partially enlarged plan view of a part of an ultrasonic sensor 10B according to the third embodiment.

As shown in FIG. 9, in the embodiment, like the ultrasonic sensor 10 of the first embodiment, the substrate 11 having the opening portions 11A, the vibrating plates 12, and the piezoelectric elements 13 are provided.

Like the first embodiment, the piezoelectric element 13 of the embodiment is also formed by a part in which a first electrode 131B, a piezoelectric material 132B, and a second electrode 133B overlap in the plan view.

Here, in the embodiment, the first electrode 131B and the piezoelectric material 132B have the same shapes and sizes as those in the first embodiment.

The second electrode 133B is formed in the same shape as the first electrode 131B and placed to overlap with the first electrode 131B in the plan view.

That is, in the embodiment, the piezoelectric element 13 is formed by the entire first electrode 131B, the entire second electrode 133B, and a part of the piezoelectric material 132B overlapping in the plan view.

Further, in the embodiment, the coupling electrodes coupled to the piezoelectric element 13 include first wiring electrodes 141B as first coupling electrodes and second wiring electrodes 142B as second coupling electrodes.

Like the first embodiment, the first wiring electrodes 141B are coupled to ±Y sides in the first electrode 131B overlapping with the corner portion neighborhood ranges P1 to P4 of the piezoelectric element 13 in the plan view and extended along the Y direction.

Like the second embodiment, the second wiring electrodes 142B are coupled to ±X sides of the second electrode 133B overlapping with the corner portion neighborhood ranges P1 to P4 of the piezoelectric element 13 in the plan view and extended along the X direction.

In the embodiment, the same functions and effects as those of the above described first embodiment and second embodiment may be exerted.

That is, in the embodiment, the first wiring electrodes 141B and the second wiring electrodes 142B are coupled to the corner portions C1 to C4 as singularities where the piezoelectric element 13 is least likely to deform when the drive voltage is applied to the piezoelectric element 13. Thus, the first wiring electrodes 141B and the second wiring electrodes 142B are unlikely to deform when the drive voltage is applied to the piezoelectric element 13 and breakage of the first wiring electrodes 141B and the second wiring electrodes 142B is suppressed. Thereby, the ultrasonic sensor 10B with higher wiring reliability may be obtained.

MODIFIED EXAMPLES

The present disclosure is not limited to the above described respective embodiments. The present disclosure includes modifications and improvements within the range in which the purpose of the present disclosure may be achieved and configurations obtained by appropriate combinations of the respective embodiments or the like.

Modified Example 1

In the first embodiment, the example in which the second wiring electrode 142 is coupled to the center parts of the second electrode 133 is shown, however, the configuration is not limited to that. For example, the electrode may be coupled to corner portion neighborhoods of the second electrode 133. The same applies to the second embodiment, and the first wiring electrode 141A may be coupled to corner portion neighborhoods of the first electrode 131A.

Modified Example 2

In the examples shown in the first embodiment to the third embodiment, the example in which the piezoelectric element 13 has a square shape is shown, however, the configuration is not limited to that.

Figure 10:
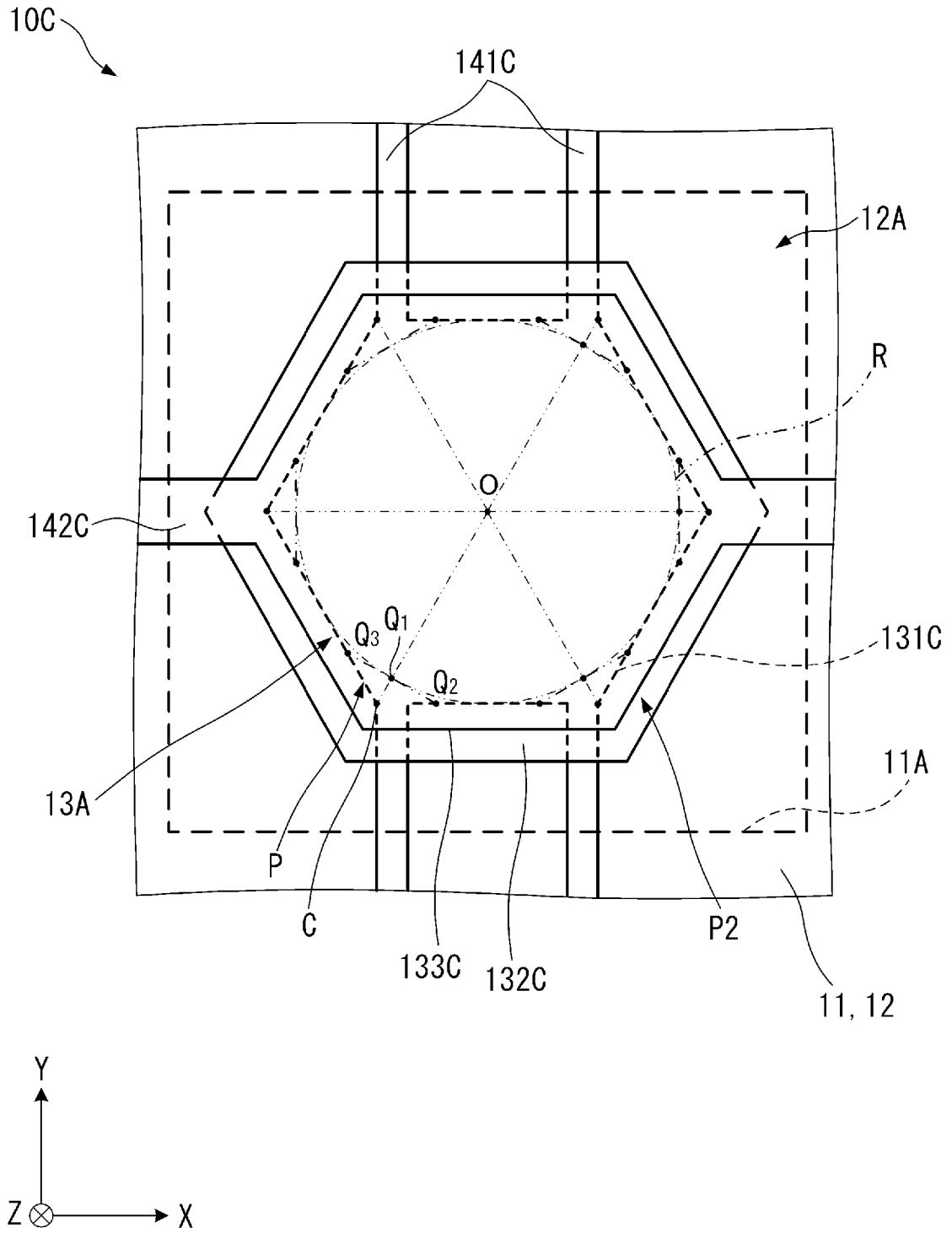
FIG. 10 is a partially enlarged plan view of an ultrasonic sensor according to modified example 2.

For example, as shown in FIG. 10, a piezoelectric element 13A having a hexagonal shape in the plan view may be employed. Also, in this case, an intersection point of a first virtual line connecting each corner portion C and a center of a virtual circle R with the virtual circle R is a first intersection point $Q_1$, and intersection points of a tangent line of the virtual circle R at the first intersection point with respective sides of the piezoelectric element 13A are a second intersection point $Q_2$ and a third intersection point $Q_3$. A first wiring electrode 141C is coupled to a corner portion neighborhood range P from the second intersection point $Q_2$ to the third intersection point $Q_3$.

In the example of FIG. 10, the first wiring electrodes 141C coupled to the first electrode 131C are coupling electrodes coupled directly to the piezoelectric element 13A. When the second electrode 133C and the piezoelectric element 13A coincide like those in the second embodiment and the third embodiment, the second wiring electrode 142C may be configured to couple to the corner portion neighborhood range P of the second electrode 133C as a coupling electrode.

Note that the virtual circle in the present disclosure is not necessarily a perfect circle. For example, in an example shown in FIG. 11, a shape of the piezoelectric element 13B in the plan view is a rectangular shape. In this case, an oval inscribed in the respective sides of the rectangular shape is a virtual circle $R_2$. Therefore, an intersection point of the oval virtual circle $R_2$ with a first virtual line $L_1$ connecting a point of the center of gravity O and a corner portion C is a first intersection point $Q_1$, and a tangent line of the virtual circle $R_2$ at the first intersection point $Q_1$ is a second virtual line $L_2$.

Figure 11:
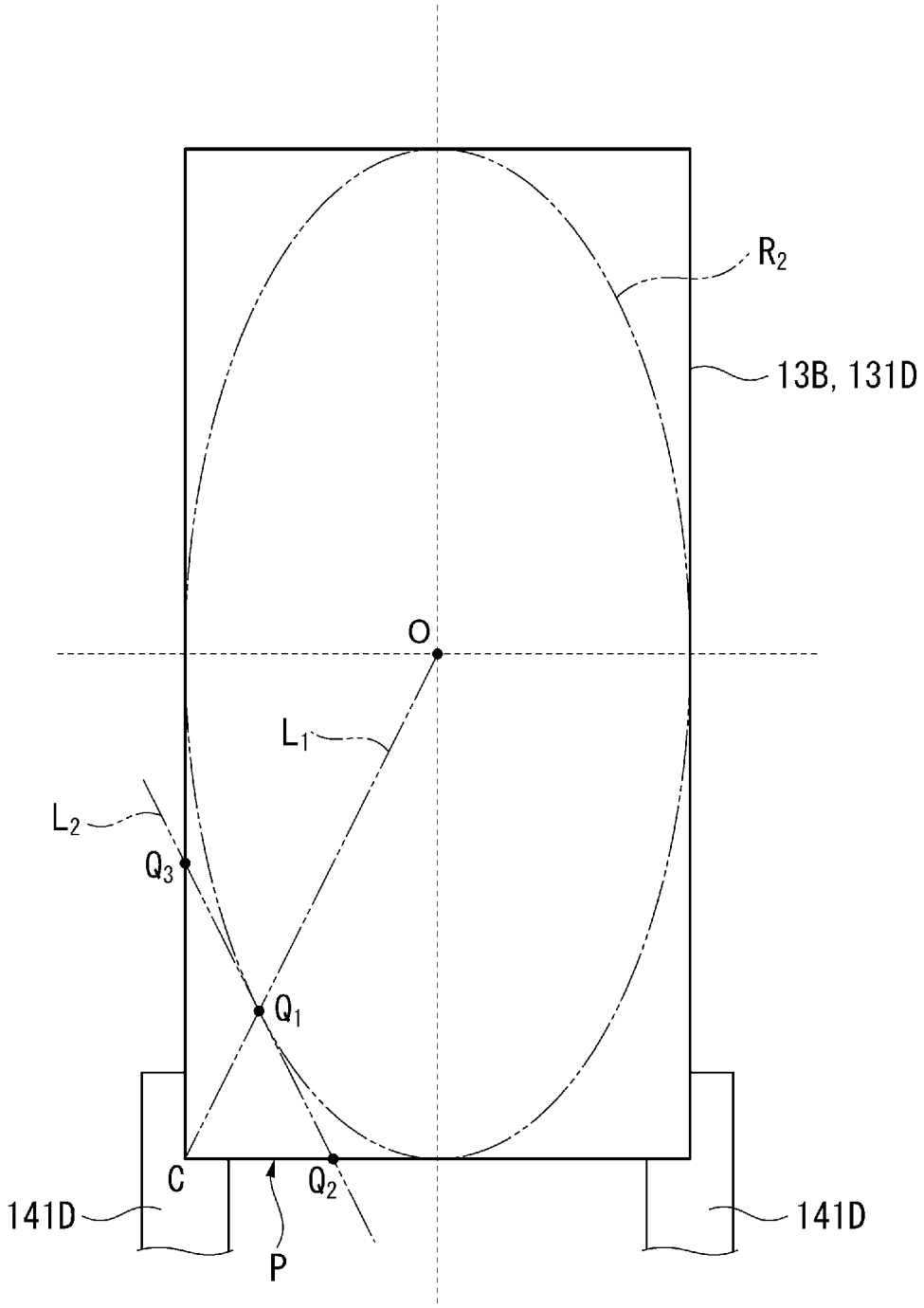
FIG. 11 shows a position relationship between a piezoelectric element and coupling electrodes of another ultrasonic sensor according to modified example 2.

In the example of FIG. 11, like the first embodiment, an entire first electrode 131D overlaps with the piezoelectric element 13B in the plan view. In this case, a first wiring electrode 141D as a coupling electrode is coupled to a corner portion neighborhood range P from the second intersection point $Q_2$ to the third intersection point $Q_3$ of the first electrode 131D overlapping with the piezoelectric element 13B.

Further, the plan view shape of the piezoelectric element is not necessarily the polygonal shape like those in the above described embodiments, FIG. 10, and FIG. 11. The plan view shape of the piezoelectric element may be e.g. a sector shape as shown in FIG. 12.

Figure 12:
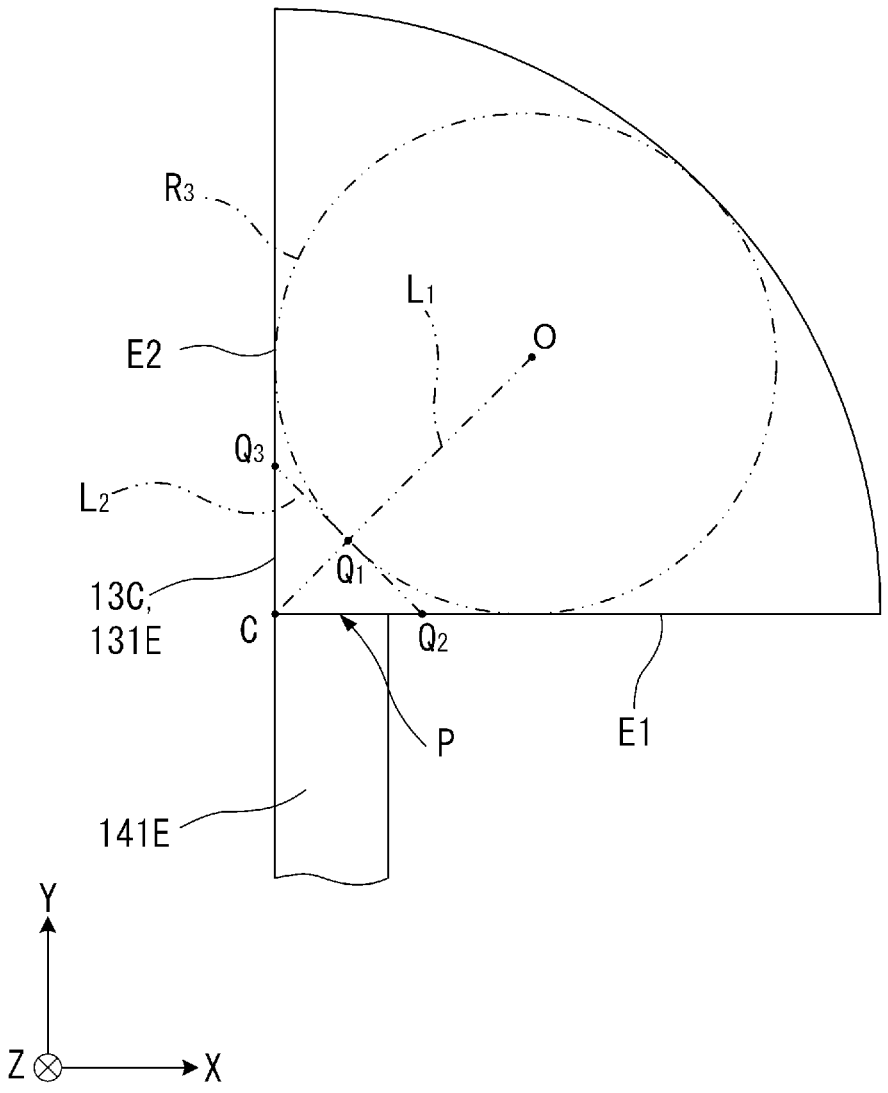
FIG. 12 shows a position relationship between a piezoelectric element and a coupling electrode of another ultrasonic sensor according to modified example 2.

In the example shown in FIG. 12, two lines as chords of a piezoelectric element 13C in the sector shape are a first line portion E1 and a second line portion E2. Further, a virtual circle $R_3$ is a circle inscribed in the chords and an arc of the sector shape.

Like the first embodiment, FIG. 12 shows an example in which an entire first electrode 131E overlaps with the piezoelectric element 13C in the plan view, and a first wiring electrode 141E as a coupling electrode is coupled to a corner portion neighborhood range P from a second intersection point $Q_2$ to a third intersection point $Q_3$ of the first electrode 131E overlapping with the piezoelectric element 13C.

Note that, in the examples shown in FIGS. 11 and 12, the coupling electrodes are the first wiring electrodes 141D, 141E, however, a second wiring electrode may be a coupling electrode like the second embodiment, and both the first wiring electrode and the second wiring electrode may be coupling electrodes like the third embodiment.

Modified Example 3

In the first embodiment, the example in which the first wiring electrodes 141 are coupled at the ±Y sides of the first electrode 131 is shown, however, the configuration is not limited to that. As described above, it is only necessary that the first wiring electrodes 141 are coupled to the corner portion neighborhood ranges P1 to P4. Therefore, for example, as shown in FIG. 11, the first wiring electrode 141 may be coupled from the side at the −Y side to the side at the −X side of the first electrode 131 or the first wiring electrode 141 may be coupled from the side at the −Y side to the side at the +X side of the first electrode 131. The same applies to the second embodiment.

Modified Example 4

In the above described first embodiment, the distance measuring apparatus 100 is exemplified as an example of an ultrasonic apparatus, however, the apparatus is not limited to that. For example, the ultrasonic apparatus may be applied to an ultrasonic measuring apparatus that measures inner cross-sectional images of a structure according to transmission and reception results of ultrasonic wave or the like.

In addition, a specific structure when the present disclosure is embodied may be configured by an appropriate combination of the above described embodiments and modified examples within a range in which the purpose of the present disclosure may be achieved, or may be appropriately changed to another structure.

What is claimed is:

1. An ultrasonic sensor comprising:

a substrate having a first surface and a second surface in a front-back relationship with the first surface and having an opening portion penetrating from the first surface to the second surface;

a vibrating plate provided on the first surface of the substrate and covering the opening portion;

a piezoelectric element provided in a position overlapping with the opening portion in a plan view as seen from a direction from the first surface to the second surface in the vibrating plate; and a coupling electrode coupled to the piezoelectric element, extended from a position overlapping with the opening portion to a position not overlapping with the opening portion in the plan view, and having a line width smaller than a width of the piezoelectric element, wherein the piezoelectric element has an outline including a first line portion, a second line portion, and a corner portion coupling the first line portion and the second line portion in the plan view, when an intersection point of a first virtual line connecting a point of a center of gravity of the piezoelectric element and the corner portion with a virtual circle inscribed in the outline of the piezoelectric element is a first intersection point, an intersection point of a tangent line of the virtual circle at the first intersection point with the first line portion is a second intersection point, and an intersection point of the tangent line of the virtual circle at the first intersection point with the second line portion is a third intersection point, the coupling electrode is coupled to a corner portion within a range from the second intersection point through the corner portion to the third intersection point in the outline of the piezoelectric element.

2. The ultrasonic sensor according to claim 1, further comprising:

a first electrode provided on the vibrating plate;

a piezoelectric material provided on the first electrode at an opposite side to the vibrating plate and covering the first electrode; and a second electrode provided on the piezoelectric material at an opposite side to the first electrode, wherein the first electrode is provided inside of an outer peripheral edge of the second electrode in the plan view, the piezoelectric element is formed by a part in which the first electrode, the piezoelectric material, and the second electrode overlap in the plan view, and the coupling electrode is an electrode coupled to the first electrode.

3. The ultrasonic sensor according to claim 1, further comprising:

a first electrode provided on the vibrating plate;

a piezoelectric material provided on the first electrode at an opposite side to the vibrating plate; and a second electrode provided on the piezoelectric material at an opposite side to the first electrode, wherein the second electrode is provided inside of an outer peripheral edge of the first electrode in the plan view, the piezoelectric element is formed by a part in which the first electrode, the piezoelectric material, and the second electrode overlap in the plan view, and the coupling electrode is an electrode coupled to the second electrode.

4. The ultrasonic sensor according to claim 1, further comprising:

a first electrode provided on the vibrating plate;

a piezoelectric material provided on the first electrode at an opposite side to the vibrating plate; and a second electrode provided on the piezoelectric material at an opposite side to the first electrode, wherein the second electrode has the same shape as the first electrode and overlaps with the first electrode in the plan view, the piezoelectric element is formed by a part in which the first electrode, the piezoelectric material, and the second electrode overlap in the plan view, and the coupling electrode includes a first coupling electrode coupled to the first electrode and a second coupling electrode coupled to the second electrode.

5. The ultrasonic sensor according to claim 1, further comprising:

a terminal portion coupled to a circuit board; and a bypass electrode coupling the terminal portion and the coupling electrode, wherein the line width of the coupling electrode and a line width of the bypass electrode are the same width.

6. An ultrasonic apparatus comprising:

the ultrasonic sensor according to claim 1; and a control unit that controls the ultrasonic sensor.

* * * * *